US009997172B2

(12) United States Patent
Barreda et al.

(10) Patent No.: US 9,997,172 B2
(45) Date of Patent: Jun. 12, 2018

(54) VOICE ACTIVITY DETECTION (VAD) FOR A CODED SPEECH BITSTREAM WITHOUT DECODING

(71) Applicant: Nuance Communications, Inc., Burlington, MA (US)

(72) Inventors: Daniel A. Barreda, London (GB); Jose E. G. Lainez, London (GB); Dushyant Sharma, Marlow (GB); Patrick Naylor, Reading (GB)

(73) Assignee: Nuance Communications, Inc., Burlington, MA (US)

( * ) Notice: Subject to any disclaimer, the term of this patent is extended or adjusted under 35 U.S.C. 154(b) by 370 days.

(21) Appl. No.: 14/094,025

(22) Filed: Dec. 2, 2013

(65) Prior Publication Data

US 2015/0154981 A1 Jun. 4, 2015

(51) Int. Cl.
*G10L 19/00* (2013.01)
*G10L 25/78* (2013.01)

(52) U.S. Cl.
CPC ..... *G10L 25/78* (2013.01)

(58) Field of Classification Search
CPC ..... G10L 25/78; G10L 25/84; G10L 19/18; G10L 19/22; G10L 19/24
USPC ..... 704/201, 219, 226, 232; 370/311; 382/224; 455/67.11
See application file for complete search history.

(56) References Cited

U.S. PATENT DOCUMENTS 5,751,903 A * 5/1998 Swaminathan ..... G10L 19/06 704/219
6,044,343 A * 3/2000 Cong ..... G10L 15/063 704/222
6,404,925 B1 * 6/2002 Foote ..... G06F 17/30746 348/480
6,765,931 B1 * 7/2004 Rabenko ..... H04B 3/23 348/E7.049
6,912,499 B1 * 6/2005 Sabourin ..... G10L 15/063 704/243
8,090,588 B2 * 1/2012 Ojala ..... G10L 19/012 370/477
8,095,361 B2 * 1/2012 Wang ..... G10L 21/0208 704/226

(Continued)

OTHER PUBLICATIONS

Beritelli et al, Performance Evaluation and Comparison of ITU-T/ETSI Voice Activity Detectors, 2001, Dipartimento di Ingegneria Informatica e delle Telecomunicazioni—University of Catania, all pages.*

(Continued)

*Primary Examiner* — Michael Colucci
(74) *Attorney, Agent, or Firm* — Hamilton, Brook, Smith & Reynolds, P.C.

(57) ABSTRACT

A system, method and computer program product are described for voice activity detection (VAD) within a digitally encoded bitstream. A parameter extraction module is configured to extract parameters from a sequence of coded frames from a digitally encoded bitstream containing speech. A VAD classifier is configured to operate with input of the digitally encoded bitstream to evaluate each coded frame based on bitstream coding parameter classification features to output a VAD decision indicative of whether or not speech is present in one or more of the coded frames.

17 Claims, 2 Drawing Sheets

(56) References Cited

U.S. PATENT DOCUMENTS 8,650,029 B2 * 2/2014 Thambiratnam ..... G10L 25/84 704/200
8,977,556 B2 * 3/2015 Sehlstedt ..... G10L 19/0204 704/210
2003/0204394 A1 * 10/2003 Garudadri ..... G10L 15/02 704/201
2005/0003766 A1 * 1/2005 Chen ..... H04L 1/0025 455/67.11
2005/0049855 A1 * 3/2005 Chong-White ..... G10L 19/173 704/219
2005/0177364 A1 * 8/2005 Jelinek ..... G10L 19/20 704/214
2006/0200346 A1 * 9/2006 Chan ..... G10L 25/69 704/233
2007/0265842 A1 * 11/2007 Jarvinen ..... G10L 25/78 704/214
2009/0271190 A1 * 10/2009 Niemisto ..... G10L 25/78 704/233
2010/0057453 A1 * 3/2010 Valsan ..... G10L 25/78 704/232
2011/0134908 A1 * 6/2011 Almalki ..... H04W 72/1215 370/352
2011/0205947 A1 * 8/2011 Xin ..... H04W 72/04 370/311
2012/0124029 A1 * 5/2012 Kant ..... G06F 17/3002 707/715
2012/0182913 A1 * 7/2012 Kreuzer ..... H04W 28/06 370/311
2012/0209604 A1 * 8/2012 Sehlstedt ..... G10L 25/78 704/233
2012/0232896 A1 * 9/2012 Taleb ..... G10L 25/78 704/233
2014/0278397 A1 * 9/2014 Chen ..... G10L 21/02 704/233
2014/0303968 A1 * 10/2014 Ward ..... G10L 25/90 704/207
2014/0379332 A1 * 12/2014 Rodriguez ..... G10L 17/00 704/219

OTHER PUBLICATIONS

"Performance Evaluation and Comparison of G.729/AMR/Fuzzy Voice Activity Detectors", by F. Beritelli, et al., *IEEE Signal Processing Letters*, vol. 9, No. 3, Mar. 2002, 4 pages.
"A Statistical Model-Based Voice Activity Detection", by Jongseo Sohn, et al., *IEEE Signal Processing Letters*, vol. 6, No. 1, Jan. 1999, 3 pages.
"Noise Power Spectral Density Estimation Based on Optimal Smoothing and Minimum Statistics", by Rainer Martin, *IEEE Transactions on Speech and Audio Processing*, vol. 9, No. 5, Jul. 2001, pp. 504-512.
"Series P: Telephone Transmission Quality, Telephone Installations, Local Line Networks", *ITU-T coded-speech database*, Series P Supplement 23 to ITU-T P-series Recommendations, Feb. 1998, 12 pages.

* cited by examiner

VOICE ACTIVITY DETECTION (VAD) FOR A CODED SPEECH BITSTREAM WITHOUT DECODING

FIELD OF THE INVENTION

The present invention relates to speech signal processing, and in particular to voice activity detection within a coded speech bitstream without decoding.

BACKGROUND ART

In the context of voice communication over a digital network, the input audio signal is typically encoded using a speech codec such as the well-known Adaptive Multi-Rate (AMR) codec. In such applications, it is useful to detect which frames in the digital bitstream contain speech and which frames contain non-speech audio, an undertaking referred to as Voice Activity Detection (VAD). But that can be a non-trivial processing task that involves decoding the AMR signal back to uncompressed audio signals in linear PCM format, extracting features from them and running complex algorithms. The AMR codec does have its own inherent VAD module that is used to enable discontinuous transmission (DTX), but it is designed to be very conservative so it is not robust to high noise and it is not configurable.

SUMMARY OF THE INVENTION

Embodiments of the present invention are directed systems, methods and computer program products for voice activity detection (VAD) within a digitally encoded bitstream. A parameter extraction module is configured to extract parameters from a sequence of coded frames from a digitally encoded bitstream containing speech. A VAD classifier is configured to operate with input of the digitally encoded bitstream to evaluate each coded frame based on bitstream coding parameter classification features to output a VAD decision indicative of whether or not speech is present in one or more of the coded frames.

There may further be a VAD smoothing module that smooths the VAD decisions for the coded frames based on the VAD decisions for some number N neighboring coded frames. In some embodiments, a hysteresis module may be used to introduce a hysteresis element to the VAD decisions based on a defined hold on and/or hold off time.

The VAD classifier may specifically be a Classification and Regression Tree (CART) classifier, or a Deep Belief Network (DBN) classifier and/or one or more of multiple VAD classifiers selected based on the bit rate of the digital bitstream. And the digital bitstream may specifically be an AMR encoded bitstream so that the bitstream coding parameter classification features are AMR encoding features.

DETAILED DESCRIPTION OF SPECIFIC EMBODIMENTS

Embodiments of the present invention provide a VAD arrangement that operates in the bitstream domain without decoding back into the speech domain. A simple binary tree classifier is used which has a low computational complexity.

Figure 1:
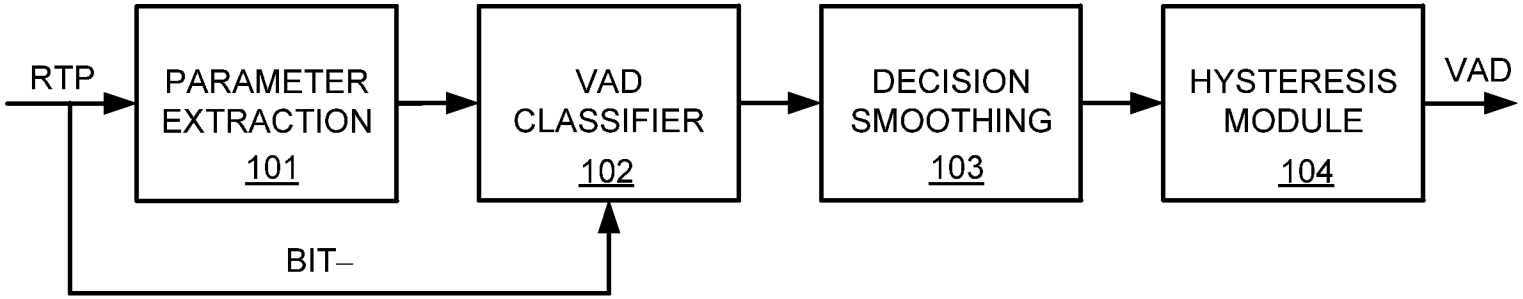
FIG. 1 shows functional modules in a VAD system according to one embodiment of the present invention.
Figure 2:
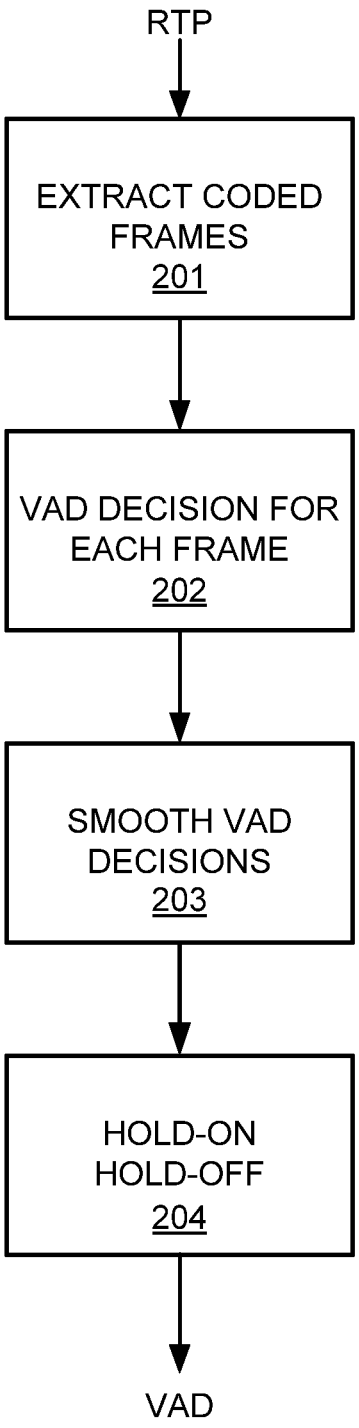
FIG. 2 shows various functional steps in a VAD method according to an embodiment of the present invention.

FIG. 1 shows functional modules and FIG. 2 shows various functional steps in a VAD arrangement according to an embodiment of the present invention. A parameter extraction module 101 extracts a sequence of coded frames from a digital bitstream containing regions of speech audio and regions of non-speech audio, step 201. For example, the digital bitstream may specifically be an AMR encoded bitstream coming in Real-time Transport Protocol (RTP) packets so that the parameter extraction module 101 extracts the AMR encoded frames from the RTP packets.

A VAD classifier 102 operates in the bitstream domain to evaluate each coded frame from the parameter extraction module 101 using the bitstream coding parameter classification features to make a VAD decision whether or not speech is present, step 202. The VAD classifier 102 can be in the specific form of a binary tree classifier such as a Classification and Regression Tree (CART) classifier or a Deep Belief Network (DBN) classifier that uses the raw bitstream parameters as the classification features. Thus, for each AMR encoded frame, the VAD classifier 102 evaluates the AMR coding parameters as its classification features to obtain a VAD decision (speech/non-speech).

The VAD classifier 102 can be trained on AMR encoded audio training files that are marked as to which areas correspond to speech and which areas correspond to non-speech. And since the AMR codec can transmit RTP packets at different bit-rates (12.2, 10.2, 7.95, 7.4, 6.7, 5.9, 5.15, 4.75 kbps), a different VAD classifier 102 should be trained for each different bit-rate bitstream. For a specific AMR bit-rate, a training database is chosen that contains training audio files labelled for speech/silence.

In one set of experiments, a small training database was used that contained about 20 minutes of carefully hand-labelled audio file recordings from 8 different devices in 6 languages with different background conditions including background babble (restaurant and office), car, street, train, computer server and kitchen extractor fan noise. The training database was transformed from the original input audio files into a set of AMR encoded frames at the desired bit-rate and encode in AMR with discontinuous transmission (DTX) disabled. For example, the publicly available 3 GPP AMR programs can be used for this purpose. The encoded signal was processed to extract the 57 AMR parameters for every audio frame (20 ms), corresponding to the bitstream content of an RTP packet. The training file was then built by merging the AMR encoded frames and the speech/silence labels. For each audio frame in the training database, this training file contained the 57 AMR parameters plus its corresponding speech/silence label. The CART model was then trained using the WEKA open source machine learning toolkit with an implementation of the CART algorithm. This training process was repeated for each of the different AMR bit-rates to generate eight binary classification trees that were able to classify each AMR frame into speech or silence without the need for decoding the stream into audio PCM.

Overall system performance can be improved by further post-classification processing. For example, a VAD smoothing module 103 smooths the VAD decisions, step 203, for the coded frames based on the VAD decisions by the VAD classifier 102 for some number N neighboring coded frames based on a majority vote scheme. A hysteresis module 104 introduces a hysteresis element to the VAD decisions based on a defined hold on and/or hold off time, step 204. This means that the per-frame VAD decision can be affected by previous or future decisions of the VAD classifier 102. The number (N) of neighbour frames used in the VAD smoothing module 103 along with the hold-off time in the hysteresis module 104 should be chosen thoughtfully depending on the maximum delay allowed by the system. However, the hysteresis module 104 can apply the hold-on time (e.g., 150 msec before/300 msec after) without incurring in any delay.

Such VAD arrangements that make a direct classification decision over the bitstream, don't need to decode the AMR signal and so save considerable computational overhead in a network infrastructure application. The classification algorithm has low computational complexity which can be highly important in a network that processes thousands of simultaneous calls per processing node.

Embodiments of the invention may be implemented in whole or in part in any conventional computer programming language. For example, preferred embodiments may be implemented in a procedural programming language (e.g., "C") or an object oriented programming language (e.g., "C++", Python). Alternative embodiments of the invention may be implemented as pre-programmed hardware elements, other related components, or as a combination of hardware and software components.

Embodiments can be implemented in whole or in part as a computer program product for use with a computer system. Such implementation may include a series of computer instructions fixed either on a tangible medium, such as a computer readable medium (e.g., a diskette, CD-ROM, ROM, or fixed disk) or transmittable to a computer system, via a modem or other interface device, such as a communications adapter connected to a network over a medium. The medium may be either a tangible medium (e.g., optical or analog communications lines) or a medium implemented with wireless techniques (e.g., microwave, infrared or other transmission techniques). The series of computer instructions embodies all or part of the functionality previously described herein with respect to the system. Those skilled in the art should appreciate that such computer instructions can be written in a number of programming languages for use with many computer architectures or operating systems. Furthermore, such instructions may be stored in any memory device, such as semiconductor, magnetic, optical or other memory devices, and may be transmitted using any communications technology, such as optical, infrared, microwave, or other transmission technologies. It is expected that such a computer program product may be distributed as a removable medium with accompanying printed or electronic documentation (e.g., shrink wrapped software), preloaded with a computer system (e.g., on system ROM or fixed disk), or distributed from a server or electronic bulletin board over the network (e.g., the Internet or World Wide Web). Of course, some embodiments of the invention may be implemented as a combination of both software (e.g., a computer program product) and hardware. Still other embodiments of the invention are implemented as entirely hardware, or entirely software (e.g., a computer program product).

Although various exemplary embodiments of the invention have been disclosed, it should be apparent to those skilled in the art that various changes and modifications can be made which will achieve some of the advantages of the invention without departing from the true scope of the invention.

What is claimed is:

1. A system for voice activity detection (VAD) within a digitally encoded bitstream, the system comprising:

a parameter extraction module implemented using one or more hardware processors and configured to extract parameters from a sequence of coded frames from a digitally encoded bitstream containing speech, the parameters extracted being parameters of a codec used in encoding the sequence of coded frames;

a VAD classifier selection module configured to:

determine a bit rate of the digitally encoded bitstream; and select a given VAD classifier from among a plurality of VAD classifiers based on the determined bit rate, the given VAD classifier having been trained for the determined bit rate of the digitally encoded bitstream with a training file corresponding to the determined bit rate; and the given VAD classifier implemented using the one or more hardware processors and configured to operate exclusively in a bitstream domain with input of the digitally encoded bitstream to output a VAD decision indicative of whether or not speech is present in one or more of the coded frames, the VAD decision determined through evaluation of the one or more of the coded frames based on bitstream coding parameter classification features and the parameters extracted.

2. The system according to claim 1, further comprising:

a speech enhancement module configured to perform speech enhancement based on the VAD decision.

3. The system according to claim 1, further comprising:

a VAD smoothing module configured to smooth the VAD decision for the one or more of the coded frames based on VAD decisions of some number N neighboring coded frames.

4. The system according to claim 1, further comprising:

a hysteresis module configured to introduce a hysteresis element to the VAD decision based on at least one of: a defined hold on and hold off time.

5. The system according to claim 1, wherein the given VAD classifier is a Classification and Regression Tree (CART) classifier or a Deep Belief Network (DBN) classifier.

6. The system according to claim 1, wherein the digital bitstream is an adaptive multi-rate (AMR) coded bitstream and the bitstream coding parameter classification features are AMR encoding features.

7. A method for voice activity detection implemented as a plurality of computer processes executing on at least one hardware processor, the method comprising:

extracting parameters from a sequence of coded frames from a digitally encoded bitstream containing speech, the parameters extracted being parameters of a codec used in encoding the sequence of coded frames;

determining a bit rate of the digitally encoded bitstream;

selecting a given VAD classifier from among a plurality of VAD classifiers based on the determined bit rate, the given VAD classifier having been trained for the determined bit rate of the digitally encoded bitstream with a training file corresponding to the determined bit rate;

evaluating one or more of the coded frames with the given VAD classifier, the given VAD classifier configured to operate exclusively in a bitstream domain with input of the digitally encoded bitstream and make a VAD decision for the one or more of the coded frames based on bitstream coding parameter classification features and the parameters extracted; and outputting the VAD decision indicating whether or not speech is present in the one or more of the coded frames.

8. The method according to claim 7, further comprising:

based on the VAD decision, making an enhancement decision whether or not to perform speech enhancement processing.

9. The method according to claim 7, further comprising:

smoothing the VAD decision for the one or more of the coded frames based on VAD decisions of some number N neighboring coded frames.

10. The method according to claim 7, further comprising:

introducing a hysteresis element to the VAD decision based on at least one of: a defined hold on and hold off time.

11. The method according to claim 7, wherein the given VAD classifier is a Classification and Regression Tree (CART) classifier or a Deep Belief Network (DBN) classifier.

12. The method according to claim 7, wherein the digital bitstream is an adaptive multi-rate (AMR) coded bitstream and the bitstream coding parameter classification features are AMR encoding features.

13. A computer program product implemented in a non-transitory computer readable storage medium for voice activity detection, the product comprising:

program code for extracting parameters from a sequence of coded frames from a digitally encoded bitstream containing speech, the parameters extracted being parameters of a codec used in encoding the sequence of coded frames;

program code for determining a bit rate of the digitally encoded bitstream;

program code for selecting a given VAD classifier from among a plurality of VAD classifiers based on the determined bit rate, the given VAD classifier having been trained for the determined bit rate of the digitally encoded bitstream with a training file corresponding to the determined bit rate;

program code for evaluating one or more of the coded frames with the given VAD classifier, the given VAD classifier configured to operate exclusively in a bitstream domain with input of the digitally encoded bitstream and make a VAD decision for the one or more of the coded frames based on bitstream coding parameter classification features and the parameters extracted; and program code for outputting the VAD decision indicating whether or not speech is present in the one or more of the coded frames.

14. The product according to claim 13, further comprising:

program code for making an enhancement decision whether or not to perform speech enhancement processing based on the VAD decision.

15. The product according to claim 13, further comprising:

program code for smoothing the VAD decision for the one or more of the coded frames based on VAD decisions of some number N neighboring coded frames.

16. The product according to claim 13, further comprising:

program code for introducing a hysteresis element to the VAD decision based on at least one of: a defined hold on and hold off time.

17. The product according to claim 13, wherein the given VAD classifier is a Classification and Regression Tree (CART) classifier or a Deep Belief Network (DBN) classifier.

* * * * *